US009751331B2

(12) United States Patent
Hamada

(10) Patent No.: US 9,751,331 B2
(45) Date of Patent: Sep. 5, 2017

(54) LIQUID DISCHARGE APPARATUS AND IMAGE FORMING METHOD

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/948,550

(22) Filed: Nov. 23, 2015

(65) Prior Publication Data

US 2016/0144632 A1 May 26, 2016

(30) Foreign Application Priority Data

Nov. 26, 2014 (JP) ..... 2014-238483

(51) Int. Cl.

| | |
|---|---|
| ***B41J 3/407*** | (2006.01) |
| ***B41J 13/00*** | (2006.01) |
| ***B41J 11/42*** | (2006.01) |
| ***B41J 15/04*** | (2006.01) |
| ***B41J 3/28*** | (2006.01) |
| ***B41J 11/00*** | (2006.01) |

(52) U.S. Cl.

CPC ..... *B41J 3/4078* (2013.01); *B41J 11/0015* (2013.01); *B41J 11/42* (2013.01); *B41J 11/425* (2013.01); *B41J 13/0009* (2013.01); *B41J 13/0027* (2013.01); *B41J 3/28* (2013.01); *B41J 15/04* (2013.01)

(58) Field of Classification Search

CPC ..... B41J 2/2114; B41J 2/2052

See application file for complete search history.

(56) References Cited

U.S. PATENT DOCUMENTS

| | | | | |
|---|---|---|---|---|
| 2005/0212835 | A1* | 9/2005 | Konno | B41J 11/0015 347/6 |
| 2005/0219279 | A1 | 10/2005 | Goto et al. | |
| 2006/0158481 | A1* | 7/2006 | Spevak | B41J 2/2114 347/43 |
| 2007/0014616 | A1* | 1/2007 | Kinoshita | G06F 3/1205 400/76 |
| 2008/0198195 | A1 | 8/2008 | Matsumura | |
| 2009/0244145 | A1* | 10/2009 | Hara | B41J 2/17593 347/14 |

(Continued)

FOREIGN PATENT DOCUMENTS

| | | |
|---|---|---|
| JP | 2005-288910 | 10/2005 |
| JP | 2008-200893 | 9/2008 |

*Primary Examiner* — Shelby Fidler
(74) *Attorney, Agent, or Firm* — Workman Nydegger

(57) ABSTRACT

A liquid discharge apparatus includes a discharge portion, a movement portion, and a control portion capable of executing an image forming operation of forming an image on the medium by a discharge operation of causing the discharge portion to discharge the liquid and a movement operation of causing the movement portion to move the medium and the discharge portion relatively to each other in a movement direction. The control portion is capable of changing a first amount of movement that is an amount of movement to be made by the movement operation to form a first image and a second amount of movement that is an amount of movement to be made by the movement operation to form a second image in a case where after the first image is formed, the second image is formed on the first image.

9 Claims, 8 Drawing Sheets

(56) References Cited

U.S. PATENT DOCUMENTS

| | | | | |
|---|---|---|---|---|
| 2010/0247218 | A1* | 9/2010 | Sakamoto | B41J 3/60 400/583 |
| 2012/0237231 | A1* | 9/2012 | Ohshima | B41J 3/60 399/45 |
| 2013/0257943 | A1* | 10/2013 | Toya | B41J 29/393 347/9 |
| 2014/0015883 | A1* | 1/2014 | Utsunomiya | B41J 11/008 347/12 |
| 2015/0116734 | A1* | 4/2015 | Howard | B41J 2/2135 358/1.4 |
| 2016/0031245 | A1* | 2/2016 | Sreekumar | B41J 29/38 347/5 |

* cited by examiner

LIQUID DISCHARGE APPARATUS AND IMAGE FORMING METHOD

BACKGROUND

1. Technical Field

The present invention relates to a liquid discharge apparatus and image forming method.

2. Related Art

Liquid discharge apparatuses that form images on media by discharging liquid to the media have been used. Among such liquid discharge apparatuses, a typical liquid discharge apparatus forms an image on a medium by moving a liquid discharge unit and the medium relatively to each other.

For example, JP-A-2008-200893 discloses a liquid discharge apparatus capable of changing the amount of transport of a medium according to a predetermined transport condition.

SUMMARY

Among liquid discharge apparatuses that form an image on a medium by moving the medium and a liquid discharge unit relatively to each other, an apparatus capable of forming a first image by using a first liquid for a base layer or the like and forming a second image on the first image has been used. When such a liquid discharge apparatus forms a second image on a first image, it sometimes happens that a medium expands or shrinks in conjunction with formation of a first image, so that an over-edge of the first image or the second image occurs.

Incidentally, JP-A-2008-200893 mentioned above does not mention or indicate such an over-edge of an image, and does not adopt a constitution that allows restraint of the over-edge of an image.

An advantage of some aspects of the invention is that in the case where a second image is formed on a first image, over-edge of the first image or the second image is restrained.

A liquid discharge apparatus according to first aspect of the invention includes a discharge portion capable of discharging a liquid, a movement portion capable of moving a medium and the discharge portion relatively to each other, and a control portion capable of executing an image forming operation of forming an image on the medium by a discharge operation of causing the discharge portion to discharge the liquid and a movement operation of causing the movement portion to move the medium and the discharge portion relatively to each other in a movement direction. The control portion is capable of changing a first amount of movement that is an amount of movement to be made by the movement operation to form a first image and a second amount of movement that is an amount of movement to be made by the movement operation to form a second image in a case where after the first image is formed, the second image is formed on the first image.

In the foregoing liquid discharge apparatus, the movement portion may be a medium support unit that moves in the movement direction while supporting the medium, and the control portion may be capable of changing the first amount of movement and the second amount of movement separately from each other by changing the amount of movement of the medium support unit.

In the foregoing liquid discharge apparatus, the movement portion may be a transport roller that moves the medium in the movement direction, and the control portion may be capable of changing the first amount of movement and the second amount of movement separately from each other by changing an amount of rotation of the transport roller.

In the foregoing liquid discharge apparatus, the movement portion may be a discharge unit that includes the discharge portion and that moves together with the discharge portion in the movement direction, and the control portion may be capable of changing the first amount of movement and the second amount of movement separately from each other by changing the amount of movement of the discharge unit.

In the foregoing liquid discharge apparatus, if the medium expands due to formation of the first image, the control portion may execute at least one of decrease of the first amount of movement and increase of the second amount of movement.

In the foregoing liquid discharge apparatus, if the medium shrinks due to formation of the first image, the control portion may execute at least one of increase of the first amount of movement and decrease of the second amount of movement.

In the foregoing liquid discharge apparatus, the discharge portion may be capable of moving in an intersecting direction that intersects the movement direction and discharging the liquid, and the control portion may be capable of changing a discharge timing at which the discharge portion discharges the liquid while moving in the intersecting direction separately for formation of the first image and for formation of the second image.

In the foregoing liquid discharge apparatus, the control portion may change at least one of the first amount of movement and the second amount of movement based on setting information.

In this liquid discharge apparatus, the medium may be a textile, and the setting information may include information regarding at least one a material of the medium, a weaving method of the medium, a thickness of a yarn that constitutes the medium.

An image forming method according to a second aspect of the invention is an image forming method for use by a liquid discharge apparatus that includes a discharge portion capable of discharging a liquid and a movement portion capable of moving a medium and the discharge portion relatively to each other and that is capable of executing an image forming operation of forming an image on the medium by a discharge operation of causing the discharge portion to discharge the liquid and a movement operation of causing the movement portion to move the medium and the discharge portion relatively to each other in a movement direction. The method includes setting a first amount of movement that is an amount of movement to be made by the movement operation to form a first image and a second amount of movement that is an amount of movement to be made by the movement operation to form a second image in a case where after the first image is formed, the second image is formed on the first image.

According to the invention, in the case where a second image is formed on a first image, over-edge of the first image or the second image can be restrained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Recording apparatuses as liquid discharge apparatus according to embodiments of the invention will be described in detail hereinafter with reference to the accompanying drawings.

The following embodiments will be described in conjunction with an ink jet recording apparatus capable of recording by discharging from a recording head a white ink for forming a first image as a base layer and color inks (e.g., black, cyan, magenta, and yellow inks) for forming a second image of characters, graphics, etc. on the base layer. However, the recording apparatus of the invention is not limited to an ink jet recording apparatus configured to be capable of discharging the aforementioned kinds of inks (liquids).

Embodiment 1 (FIG. 1 to FIGS. 5A-5C)

First, a recording apparatus according to Embodiment 1 of the invention will be described.

Figure 1:
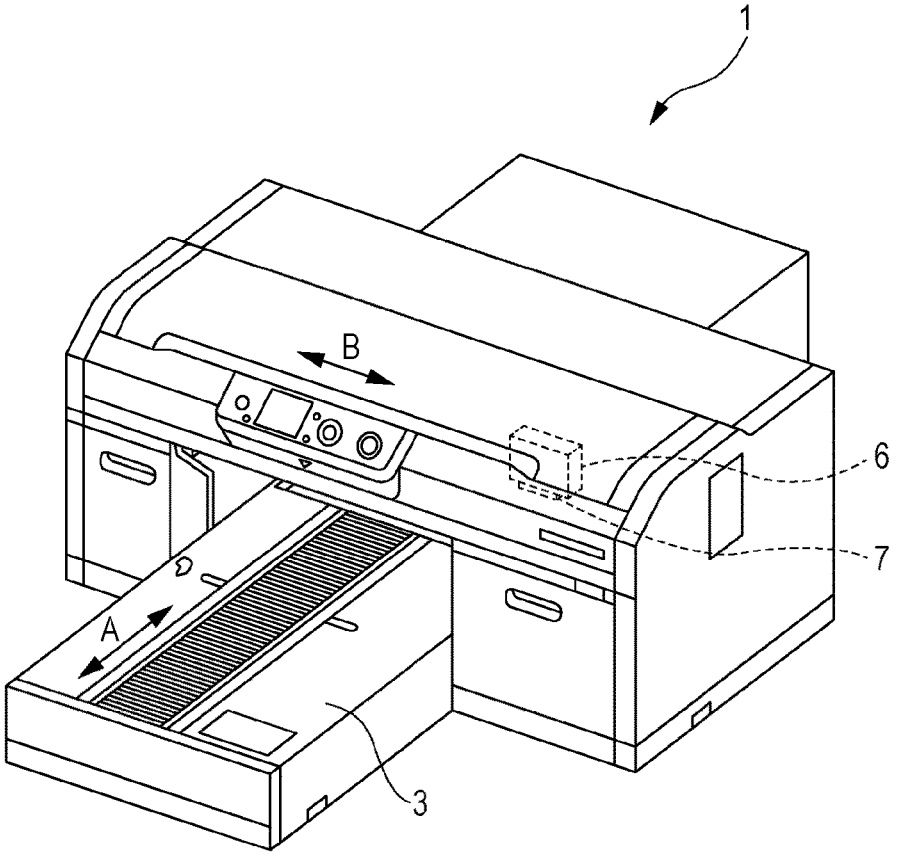
FIG. 1 is a schematic perspective view of a recording apparatus according to Embodiment 1 of the invention.
Figure 2:
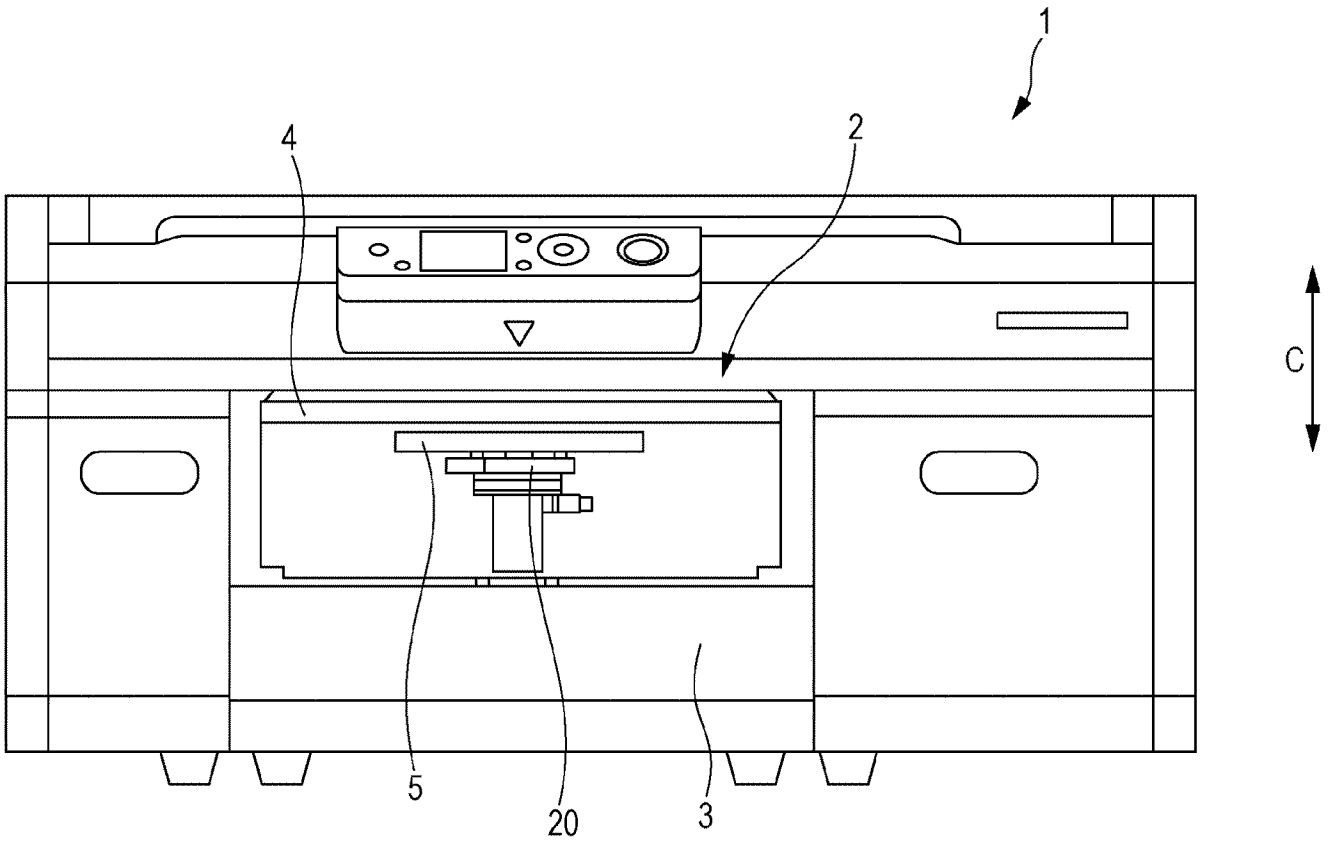
FIG. 2 is a schematic front view of the recording apparatus according to Embodiment 1 of the invention.
Figure 3:
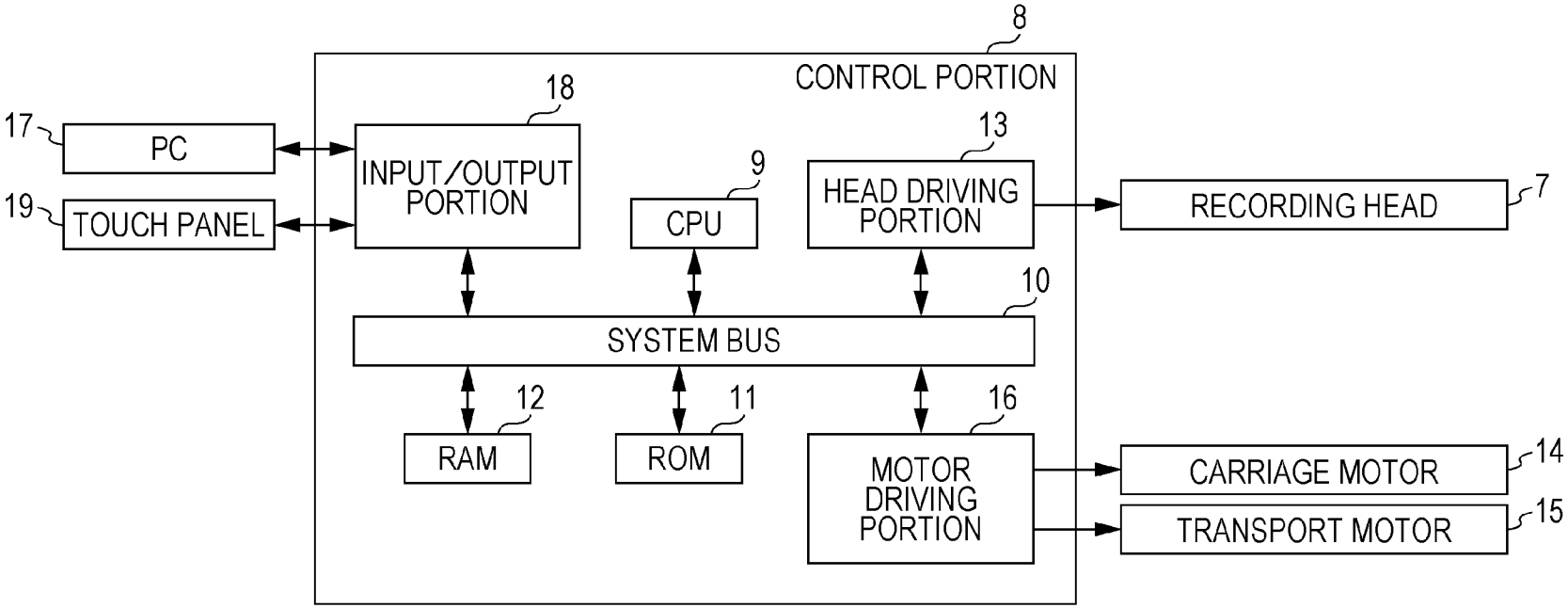
FIG. 3 is a block diagram of the recording apparatus according to Embodiment 1 of the invention.

FIG. 1 is a schematic perspective view of a recording apparatus 1 according to Embodiment 1 of the invention. FIG. 2 is a schematic front view of the recording apparatus 1 according to Embodiment 1 of the invention.

The recording apparatus 1 of this embodiment includes a medium support unit 2 that moves in movement directions A while supporting a medium P. The medium support unit 2 has a tray 4 that is a support portion for the medium. The recording apparatus 1 includes a medium transport portion 3 that transports the medium P supported by a tray 4 (see FIGS. 4A-4C) (i.e., moves the medium P and a recording head 7 as a discharge portion described below relatively to each other) in the movement directions A. The tray 4 is mounted on a stage 5. The tray 4 is moved together with the stage 5 in height directions C by turning a rotation lever 20.

Furthermore, the recording apparatus 1 includes within its main body the recording head 7 capable of discharging inks (an example of liquid). In this embodiment, the recording head 7 corresponds to a discharge portion capable of discharging liquid. That is, the liquid discharge apparatus (the recoding apparatus 1) includes a discharge portion capable of discharging liquid. The recording apparatus 1 of this embodiment moves a carriage 6 on which the recording head 7 is provided back and forth in intersecting directions B that intersect the movement directions A so that the recording head 7 as the discharge portion that discharges inks is moved back and forth in the intersecting directions when the recording apparatus 1 causes the recording head 7 to discharge the inks to the medium P supported by the tray 4 so as to form a desired image. That is, the discharge portion is capable of discharging the liquid while moving in the intersecting directions that intersect the movement directions A. Incidentally, in this embodiment, the medium P is set onto the tray 4 when the tray 4 is at a medium P-setting position that is at a front side (in a left downward direction) in FIG. 1. The recording apparatus 1 moves the tray 4 on which the medium P has been set from the medium P-setting position to a recording start position that is at a back side (in a right upward direction) and then performs recording while moving the tray 4 toward the front side in FIG. 1. At this time, the medium support unit 2 can be said to be a movement portion capable of moving relatively to the discharge portion. In other words, the liquid discharge apparatus includes a movement portion capable of moving the medium P and the discharge portion relatively to each other. The movement portion, as described below, may be constructed in a manner other than the manner described above. In this embodiment, the movement portion is the medium support unit 2 that moves in the movement directions while supporting the medium P.

Next, an electrical constitution of the recording apparatus 1 of this exemplary embodiment will be described.

FIG. 2 is a block diagram of the recording apparatus 1 of this embodiment.

A control portion 8 includes a CPU 9 that performs overall control of the recording apparatus 1. The CPU 9 is connected, via a system bus 10, to a ROM 11 in which, for example, a maintenance sequence and various control programs that the CPU 9 executes are stored and a RAM 12 capable of temporarily storing data.

Furthermore, the CPU 9 is connected, via the system bus 10, to a head driving portion 13 that drives the recording head 7.

Furthermore, the CPU 9 is also connected, via the system bus 10, to a motor driving portion 16 that drives a transport motor that is provided in the medium transport portion 3 so as to transport the medium P and a carriage motor 14 that moves a carriage 6 on which the recording head 7 is provided.

Still further, the CPU 9 is connected, via the system bus 10, to an input/output portion 18. The input/output portion 18 is connected to a touch panel 19 and a personal computer (PC) 17 for sending and receiving signals and data such as recording data.

Due to this constitution, the control portion 8 is able to control the recording head 7 and the medium transport portion 3 so as to execute an operation of forming an image on the medium P based on a discharge operation performed by the recording head 7 and an operation performed by medium transport portion 3 to move the medium P and the recording head 7 relatively to each other. In other words, the liquid discharge apparatus includes the control portion 8 capable of executing an image forming operation of forming an image on the medium P based on the discharge operation that discharges liquid by using the discharge portion and the movement operation that moves the medium P and the discharge portion relatively to each other in the movement directions by using the movement portion.

Next, the over-edge of a first image or a second image in the case of forming the second image on the first image, which is the problem to be solved by the invention, will be described.

Figure 4C:
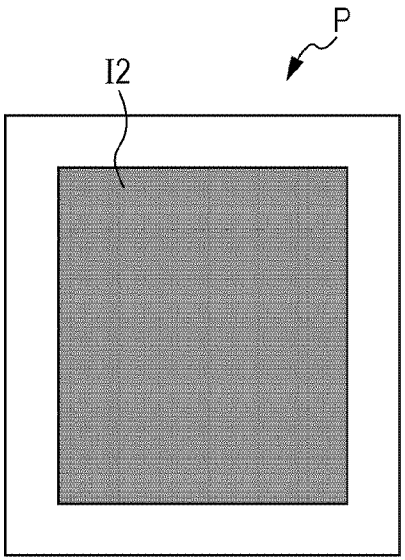
FIGS. 4A, 4B and 4C are illustrative diagram of the image forming that is performed by using the recording apparatus according to Embodiment 1 of the invention.
Figure 4B:
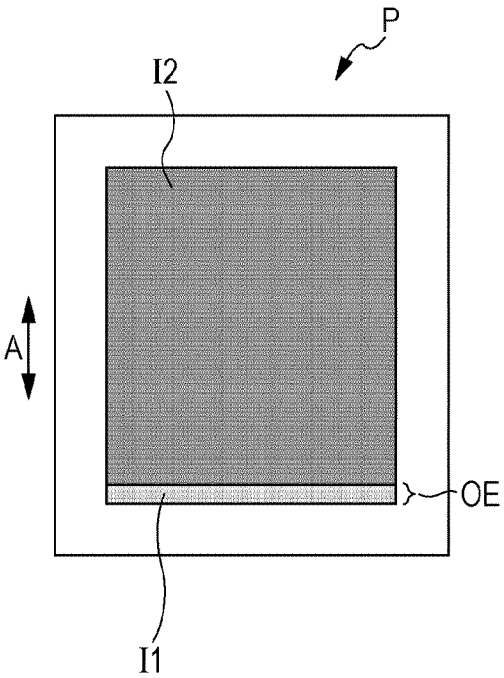
Figure 4A:
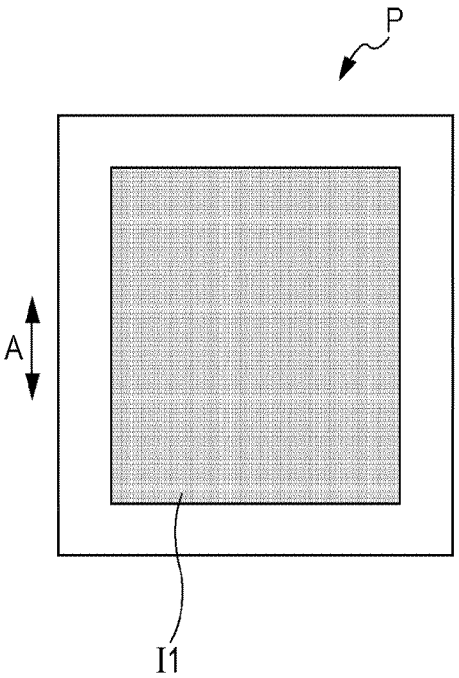

FIGS. 4A to 4C are diagrams for describing the image forming that is performed by using the recording apparatus 1 of this embodiment. More particularly, FIGS. 4A to 4C are diagrams illustrating cases where there arises and there does not arise an over-edge OE of a first image I1 presented in light gray or a second image I2 presented in dark gray in the drawings in the case where the second image I2 is formed on the first image I1.

Incidentally, longitudinal directions in FIGS. 4A to 4C (directions along long sides of the medium P shown in each of FIGS. 4A to 4C) correspond to the movement directions A, and lateral directions in FIGS. 4A to 4C (directions along short sides of the medium P shown in each of FIGS. 4A to 4C) correspond to the intersecting directions B, which are scanning directions of the recording head 7.

Herein, FIG. 4A presents a state in which the first image I1 has been formed as a base layer on the medium P by a white ink. The medium used in this embodiment is a textile having a property of easily swelling in the longitudinal directions in FIGS. 4A to 4C due to deposit of an ink. Incidentally, generally in the case of recording a medium P made of a textile, such as a garment, deposit of an ink often causes the garment or the like to expand or shrink in the length direction thereof. This results from a setting direction of the medium P, a weaving direction of a yarn that corresponds to the setting direction, or the like. In this embodiment, the medium P is set along its garment length directions, and recording is performed while the medium P and the discharge portion are moved relatively to each other in the garment length directions. That is, directions along the garment length directions are the movement directions A. Therefore, in this embodiment, it is often the case that the medium P expands or shrinks in directions along the movement directions A.

FIG. 4B presents a state in which the second image I2 has been formed on the first image I1 and, more particularly, an image forming state in which the amount of transport of the medium P made in forming the first image I1 and the amount of transport of the medium P made in forming the second image I2 are equal (both equal to an initial value). The "initial value" may be a value set as a default or may be a value set when a user performs a print setting. In this case, the initial value can be said to be a "set value". Furthermore, the initial value of the amount of transport of the medium P at the time of forming the first image I1 and the initial value of the amount of transport of the medium P at the time of forming the second image I2 may be unequal.

The second image I2 is an image formed by color inks, and is assumed to be formed on the medium P to a size equal to that of the first image I1, which is the base layer. More particularly, the second image I2 is based on an assumption that an image is formed without causing edge-over of the second image I2 from an edge of the first image I1 and without causing edge-over of the first image I1 from an edge of the second image I2.

However, if the medium P that easily swells due to deposit of ink is used, the medium P swells in the longitudinal directions in FIGS. 4A to 4C (in the movement directions A) at the time of forming the first image I1, so that the first image I1 lengthens in the longitudinal directions. Therefore, if the second image I2 equal in size to the first image I1 is formed by moving the medium P by an amount equal to the amount of movement of the medium P made at the time of forming the first image I1, an over-edge OE of the first image I1 protruded from the second image I2 results as presented in FIG. 4B.

Hence, the recording apparatus 1 of this embodiment is configured that, in the case where the medium P that easily swells due to deposit of ink is used, the amount of movement of the medium P to be made at the time of forming the first image I1 and the amount of movement of the medium P to be made at the time of forming the second image I2 can be individually set.

In other words, when controlling the recording head 7 and the medium transport portion 3 so as to form the first image I1 by a first image forming operation and then form the second image I2 on the first image I1 by a second image forming operation, the recording apparatus 1 of this embodiment is able to change a first amount of relative movement between the medium P and the recording head 7 to be made in the relative movement direction A during the first image forming operation and a second amount of relative movement therebetween to be made in the relative movement direction A during the second image forming operation separately from each other. That is, in the case of forming the first image I1 and subsequently forming the second image I2 on the first image I1, the control portion 8 is able to change the first amount of movement that is the amount of movement to be made by the movement operation to form the first image I1 and the second amount of movement that is the amount of movement to be made by the movement operation to form the second image I2 separately from each other.

Therefore, in the relative movement direction A, over-edge of the first image I1 or the second image I2 in the case where the second image I2 is formed on the first image I1 can be restrained.

Incidentally, the recording apparatus 1 of this embodiment is configured to form images while intermittently transporting the medium P, that is, performing recording by repeatedly alternating an operation of moving the medium P and the recording head 7 relatively to each other in the movement directions A and an operation of stopping the relative movement operation and then discharging inks while moving the recording head 7 in the intersecting directions B. Each of the "first amount of movement" and the "second amount of movement" is an amount of movement made by one of the intermittent transport operations.

Furthermore, the setting of the first amount of movement and the setting of the second amount of movement are not particularly limited; for example, the settings can be made by a user entering inputs via the PC 17, the touch panel 19, etc., or the settings can be made automatically by the control portion 8 based on the kind of the medium P to be used, or the like.

Furthermore, the directions in which the medium P easily expands or shrinks may also be other than the garment length directions. For example, the directions in which the medium P easily expands or shrinks may be the garment width directions or the like. It is preferable to set the medium P so that the directions in which the medium P easily expands or shrinks coincide with directions along the movement directions A.

FIG. 4C presents a state in which over-edge of the first image I1 or the second image I2 formed on the first image I1 is restrained in the relative movement direction A.

Concretely, in the case where the medium P expands due to formation of the first image I1, the control portion 8 executes at least one of the decreasing of the first amount of movement and the increasing of the second amount of movement. For example, when the first amount of movement is decreased from a set value, the size of the first image I1 in the movement directions A becomes smaller than when the set value is used as the first amount of movement. Therefore, the enlargement of the size of the first image I1 in the movement directions A involved with the expansion of the medium P can be restrained. Therefore, over-edge of the first image I1 can be restrained. When the second amount of movement is increased from a set value, the size of the second image I2 in the movement directions A becomes larger than when the set value is used as the second amount of movement. Therefore, according to the size enlargement of the first image I1 in the movement directions A involved with expansion of the medium P, the size of the second image I2 in the movement directions A can be enlarged so as to restrain over-edge of the first image I1.

Incidentally, when the set value of the first amount of movement and the set value of the second amount of movement are equal, the first amount of movement is caused to be smaller than the second amount of movement. Thus, the recording apparatus 1 of this embodiment, in the case where the medium P swells due to the first image forming operation, is able to change at least one of the first amount of movement and the second amount of movement through the control by the control portion 8 so that the first amount of movement is smaller than the second amount of movement. Therefore, the recording apparatus 1 is configured so that, in the case where a medium P that swells due to deposit of ink is used, over-edge of the first image I1 or the second image I2 formed on the first image I1 can be restrained.

In the foregoing case, the control portion 8 in this embodiment may also execute, for example, any of a control of making the first amount of movement smaller than the initial value (set value), a control of making the second amount of movement larger than the initial value (set value), and a control of making the first amount of movement smaller and making the second amount of movement larger.

On another hand, in the case where the medium P shrinks due to formation of the first image I1, the control portion 8 executes at least one of the increasing of the first amount of movement and the decreasing of the second amount of movement. For example, if the first amount of movement is increased from the original set value, the size of the first image I1 in the movement directions A becomes larger than in the case where the set value is used as the first amount of movement. Therefore, the reduction of the size of the first image I1 in the movement directions A involved with the shrinkage of the medium P can be restrained. Hence, over-edge of the second image I2 can be restrained. Furthermore, if the second amount of movement is decreased from the original set value, the size of the second image I2 in the movement directions A becomes smaller than in the case where the set value is used as the second amount of movement Therefore, according to the size reduction of the first image I1 in the movement directions A involved with the shrinkage of the medium P, the size of the second image I2 in the movement directions A can be reduced to restrain over-edge of the second image I2.

Incidentally, when the set value of the first amount of movement and the set value of the second amount of movement are equal, the first amount of movement is caused to be larger than the second amount of movement. Thus, in the case where the medium P shrinks due to the first image forming operation, the recording apparatus 1 of this embodiment can also change at least one of the first amount of movement and the second amount of movement so that the first amount of movement is larger than the second amount of movement through the control by the control portion 8. Therefore, the recording apparatus 1 is configured so that in the case where a medium P that shrinks due to deposit of ink is used, over-edge of the first image I1 or the second image I2 formed on the first image I1 can be restrained.

In the foregoing case, the control portion 8 in this embodiment is also able to execute, for example, any of a control of making the first amount of movement larger than the initial value (set value), a control of making the second amount of movement smaller than the initial value (set value), and a control of making the first amount of movement larger and making the second amount of movement smaller.

The changing of the first amount of movement and the second amount of movement will now be described.

Figure 5A:
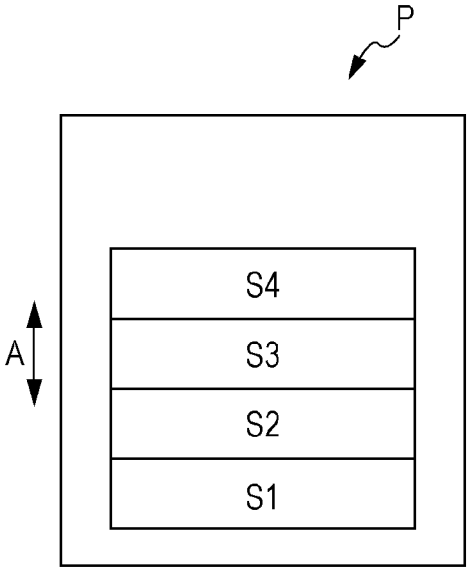
FIGS. 5A, 5B and 5C are illustrative diagram of the image forming that is performed by using the recording apparatus according to Embodiment 1 of the invention.
Figure 5B:
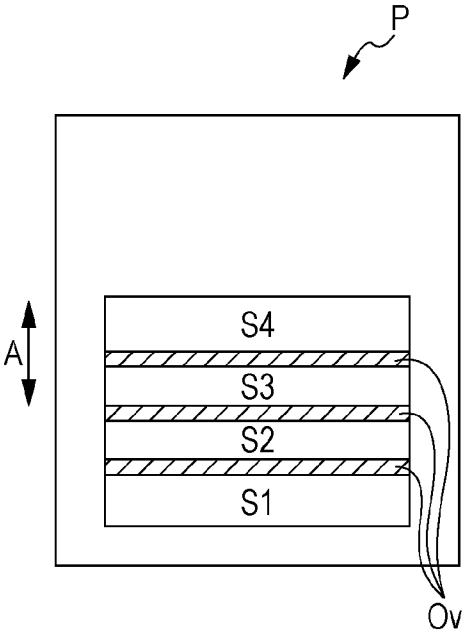
Figure 5C:
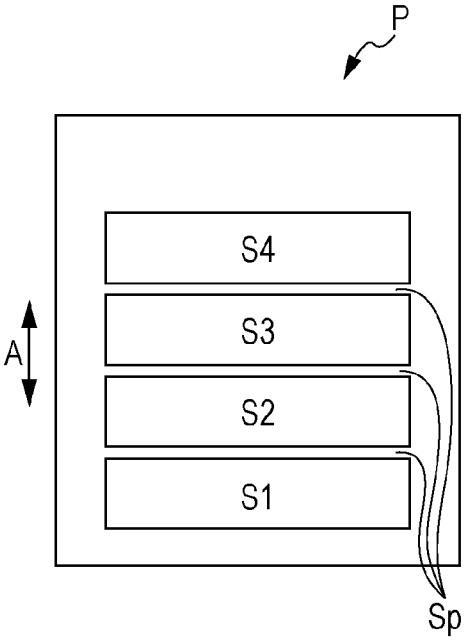

FIGS. 5A to 5C are diagrams for describing the image forming performed by using the recording apparatus 1 of this embodiment. More particularly, FIG. 5A presents a case where the first amount of movement (second amount of movement) is as usual (initial value), FIG. 5B presents a case where the first amount of movement (second amount of movement) has been made smaller than the initial value, and FIG. 5C presents a case where the first amount of movement (second amount of movement) has been made larger than the initial value.

Incidentally, in the diagrams, the longitudinal directions correspond to the movement directions A, and the lateral directions correspond to the intersecting directions, which are the scanning directions of the recording head 7.

The recording apparatus 1 of this embodiment is able to perform recording on the first scan (image-forming region S1) by discharging ink while moving the recording head 7 in the intersecting directions relative to the medium P stopped in position (discharge operation), subsequently transport the medium P by a predetermined amount of transport to which the first amount of movement and the second amount of movement correspond (movement operation), and perform recording on the second scan (image-forming region S2) by discharging ink while moving the recording head in the intersecting directions B relative to the medium P stopped in position (discharge operation). By repeating the discharge operation and the movement operation, the recording apparatus 1 is able to form the first image I1 and the second image I2 (to execute the image forming operation).

Incidentally, although the foregoing description has been made in conjunction with an example of a so-called one-pass recording in which a portion of an image to be recorded is recorded by a single scan, the recording apparatus 1 of this embodiment is also able to perform a so-called multiple-pass recording in which a portion of an image to be recorded is recorded by a plurality of scans.

FIG. 5A presents an example of the case where the first amount of movement and the second amount of movement in the case of a one-pass recording are usual amounts, presenting image forming regions S1 to S4 that correspond to scans performed by the recording head 7.

As presented in FIG. 5A, in the case where the first amount of movement and the second amount of movement are usual amounts, the image forming regions S1 to S4 that each correspond to a scan are contiguous without space or overlap in the longitudinal directions (movement directions A).

Furthermore, FIG. 5B presents an example in which the first amount of movement and the second amount of movement at the time of performing one-pass recording have been made smaller than usual, presenting image forming regions S1 to S4 that correspond to scans performed by the recording head 7.

As presented in FIG. 5B, in the case where the first amount of movement and the second amount of movement are smaller than usual, the image forming regions S1 to S4 that each correspond to a scan are side by side with overlaps Ov (regions indicated by hatching) therebetween in the longitudinal directions (movement directions A).

For example, it is preferable that the first amount of movement in the case where the medium P expands due to the first image forming operation or the second amount of movement in the case where the medium P shrinks due to the first image forming operation be made smaller than a usual amount of movement as described above.

Furthermore, FIG. 5C presents an example in which the first amount of movement and the second amount of movement at the time of performing one-pass recording have been made larger than usual, presenting image forming regions S1 to S4 that correspond to scans performed by the recording head 7.

As presented in FIG. 5C, in the case where the first amount of movement and the second amount of movement are larger than usual, the image forming regions S1 to S4 that each correspond to a scan are side by side with spaces Sp therebetween in the longitudinal directions (movement directions A).

For example, it is preferable that the first amount of movement in the case where the medium P shrinks due to the first image forming operation or the second amount of movement in the case where the medium P expands due to the first image forming operation be made larger than usual as described above.

Thus, the recording apparatus 1 of this embodiment is configured to be able to restrain over-edge of the first image I1 or the second image I2 in the movement directions A.

Furthermore, the recording apparatus 1 of this embodiment is configured to be able to restrain over-edge of the first image I1 or the second image I2 in the intersecting directions B that intersect the movement directions A.

Concretely, the control portion 8 in this embodiment is able to change the discharge timings at which the recording head discharges ink while moving in the intersecting directions separately at the time of forming the first image I1 and at the time of forming the second image I2. For example, in the case where the medium P that expands in the intersecting directions B due to deposit of ink is used, it suffices that the discharge timing is changed so as to shorten the time spent for one ink discharge operation for forming the first image I1 or so as to lengthen the time spent for one ink discharge operation for forming the second image I2. Furthermore, in the case where the medium P that shrinks in the intersecting directions B due to deposit of ink is used, it suffices that the discharge timing is changed so as to lengthen the time spent for one ink discharge operation for forming the first image I1 or so as to shorten the time spent for one ink discharge operation for forming the second image I2.

Furthermore, the control portion 8 in this embodiment is able to change the first amount of movement and the second amount of movement separately from each other based on the setting information that is set, for example, by a user entering inputs via the PC 17 or the touch panel 19. It may be one of the first amount of movement and the second amount of movement that the control portion 8 changes based on the setting information. That is, the control portion 8 changes at least one of the first amount of movement and the second amount of movement based on the setting information. Therefore, the recording apparatus 1 of this embodiment is able to restrain over-edge of the first image I1 or the second image I2 formed on the first image I1, with high accuracy, according to the pre-determined setting information.

Incidentally, the "setting information" is not particularly limited and, for example, may be information regarding the kind of the medium P, the amount of ink deposited on the medium P, the environmental conditions (temperature, humidity, etc.), the kind of ink (liquid), etc.

In the case where a textile is used as the medium P, it is preferable that, as setting information, information regarding at least one of the material of the medium P, the weaving pattern of the medium P, and the thickness of the yarn that constitutes the medium P can be set.

This is because if the setting information includes information regarding at least one of the material of the medium P, the weaving pattern of the medium P, and the thickness of the yarn that constitutes the medium P, over-edge of the first image I1 or the second image formed on the first image I1 in the case where a textile is used as the medium P can be restrained with high accuracy.

The movement portion that moves the recording head 7 and the medium P in the recording apparatus 1 of this embodiment relatively to each other is the medium support unit 2 that moves in the movement directions A, which are the directions of relative movement between the recording head 7 and the medium P, while supporting the medium P and the tray 4. The control portion 8 is able to change the first amount of movement and the second amount of movement separately from each other by changing the amount of relative movement of the medium support unit 2 in the movement directions. In other words, the control portion 8 is able to change the first amount of movement and the second amount of movement separately from each other by changing the amount of movement of the medium support unit 2.

Thus, the recording apparatus 1 of this embodiment is a recording apparatus that includes the medium support unit 2 as a movement portion. With this constitution, the recording apparatus 1 restrains over-edge of the first image I1 or the second image I2 formed on top the first image I1.

However, the invention is not limited to a constitution in which the medium support unit 2 that supports the medium P is moved relatively to the recording head 7 as in the recording apparatus 1 of this embodiment.

Hereinafter, recording apparatuses that include a movement portion different in constitution from the movement portion provided in the foregoing embodiment will be described.

Figure 6:
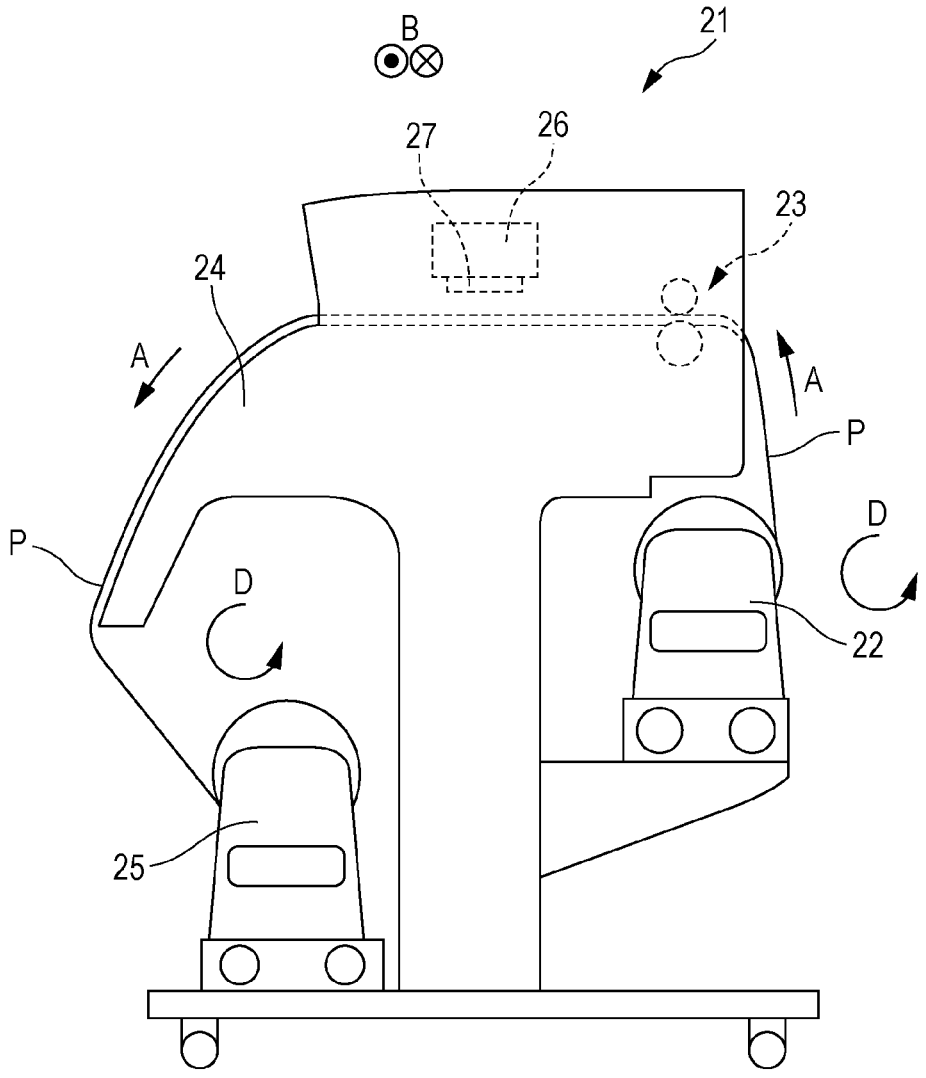
FIG. 6 is a schematic side view of a recording apparatus according to Embodiment 2 of the invention.

Embodiment 2 (FIG. 6)

Next, a recording apparatus according to Embodiment 2 of the invention will be described.

FIG. 6 is a schematic side view of a recording apparatus 21 according to Embodiment 2 of the invention.

In this embodiment, the recording apparatus 21 includes a medium-setting portion 22 for a roll-shaped medium P. The medium P can be transported from the medium-setting portion 22, via a platen that is a support portion for the medium P, to a takeup portion 25 that takes up the medium P into a roll shape. That is, the path from the medium-setting portion 22 to the takeup portion 25 is a transport path of the medium P in the recording apparatus 21. The medium-setting portion 22 feeds the medium P by rotating the roll-shaped medium P in a rotation direction D, and the takeup portion 25 takes up the medium P by rotating in the rotation direction D.

Furthermore, in the recording apparatus 21 of this embodiment, a transport roller 23 composed of a pair of rollers that each have a rotation axis in an intersecting direction B that intersects a movement direction A. In this embodiment, the transport roller 23 corresponds to the movement portion in the invention. That is, the movement portion in this embodiment is the transport roller 23 that moves the medium P in the movement direction A. Due to this constitution, along the transport path of the medium P in the recording apparatus 21 of this embodiment, the medium P fed from the medium-setting portion 22 is transported by the transport roller 23, and the medium P transported by the transport roller 23 to the takeup portion 25 is taken up by the takeup portion 25.

Furthermore, the recording apparatus 21 of this embodiment includes a recording head 27 as a discharge portion that discharges ink. The recording apparatus 21 forms a desired image by discharging ink from the recording head 27 to the medium P while moving the recording head 27 back and forth in the intersecting direction B by using a carriage 26 Due to this constitution, the recording head 27 is capable of forming images by discharging ink to the medium P.

Thus, the movement portion that moves the recording head and the medium P relatively to each other in the recording apparatus 21 of this embodiment is the transport roller 23 that has its rotation axis in the intersecting directions B. Then, a control portion 8 (not depicted in FIG. 6) is able to change the first amount of relative movement between the medium P and the recording head 27 made in the movement direction A in the first image forming operation and the second amount of relative movement therebetween made in the movement direction A in the second image forming operation by changing the amount of rotation of the transport roller 23.

Therefore, the recording apparatus 21 of this embodiment that includes the transport roller 23 as a movement portion is configured to be capable of restraining over-edge of a first image I1 or a second image I2 in the case where the second image I2 is formed on the first image I1.

Figure 7:
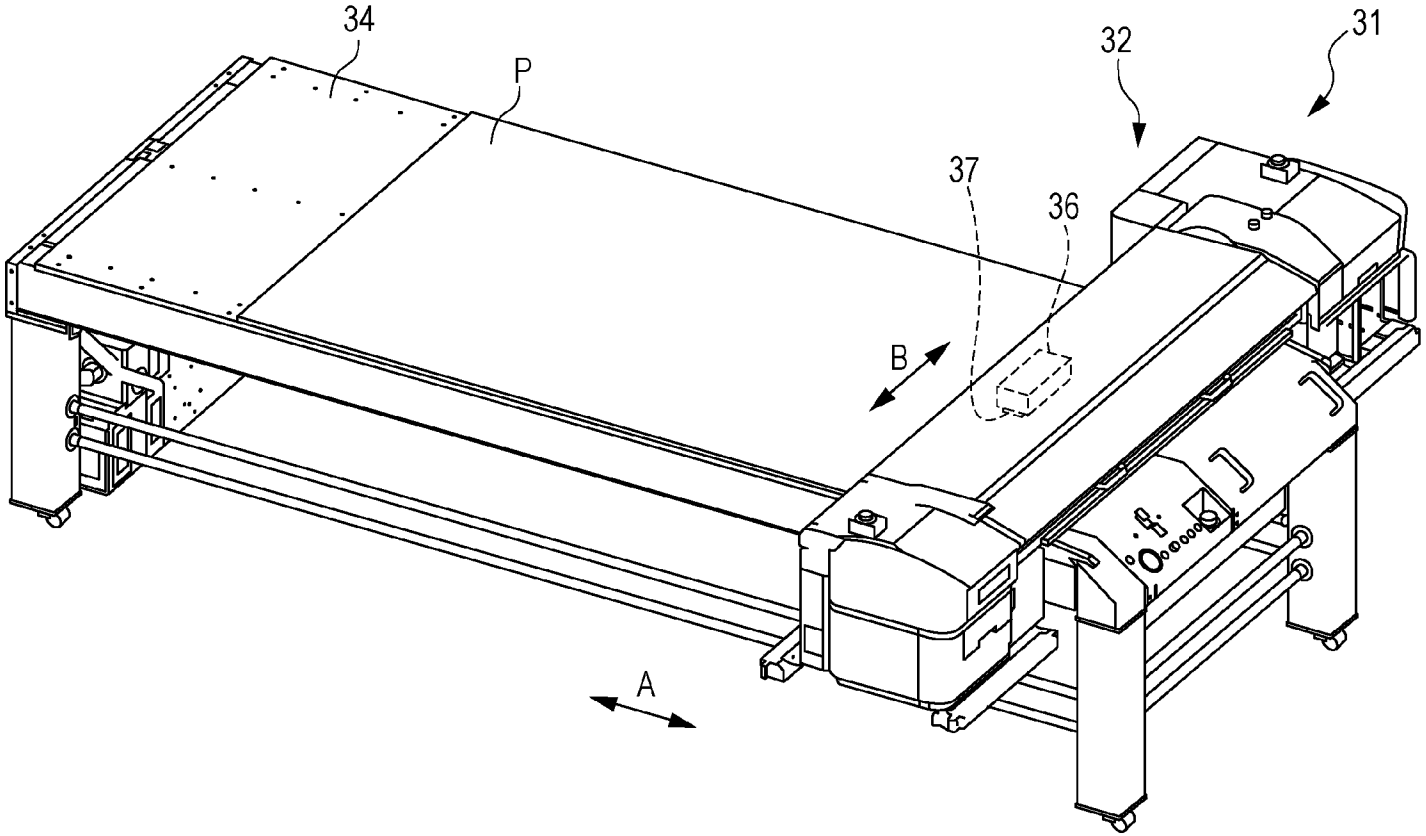
FIG. 7 is a schematic perspective view of a recording apparatus according to Embodiment 3 of the invention.

Embodiment 3 (FIG. 7)

Next, a recording apparatus according to Embodiment 3 of the invention will be described.

FIG. 7 is a schematic perspective view of a recording apparatus 31 according to Embodiment 3 of the invention.

The recording apparatus 31 of this embodiment is a so-called flat-bed type recording apparatus. The recording apparatus 31 includes a medium support portion 34 capable of supporting the medium P. Then, the recording apparatus 31 is capable of moving a main body portion 32 that includes a recording head 37 as a discharge portion that discharge ink, in the movement direction A relative to the medium support portion 34. That is, the main body portion 32 also serves the function of a discharge unit capable of moving the medium P and the recording head 37 relatively to each other in a movement direction A. That is, the movement portion in this embodiment is the discharge unit that includes the discharge portion and that moves together with the discharge portion in the movement direction A.

Furthermore, the recording head 37 is capable of being moved in the main body portion 32 in intersecting directions B that intersect the movement direction A, via a carriage 36. The recording apparatus 31 of this embodiment forms a desired image by discharging ink from the recording head 37 to the medium P while moving the recording head 37 back and forth in the intersecting directions B via the carriage 36. Due to this constitution, the recording head 37 can form images by discharging ink to the medium P.

Thus, in the recording apparatus 31 of this embodiment, the movement portion that moves the recording head 37 and the medium P relatively to each other is the main body portion 32 as the discharge unit capable of moving the recording head 37 in the relative movement direction A relatively to the medium support portion 34 that supports the medium P. Then, a control portion 8 (not depicted in FIG. 7) is able to change a first amount of relative movement between the medium P and the recording head 37 made in the relative movement direction A at the time of a first image forming operation and a second amount of relative movement therebetween made in the relative movement direction at the time of a second image forming operation separately from each other by changing the amount of movement of the main body portion 32 in the relative movement direction A. In other words, the control portion is able to change the first amount of movement and the second amount of movement separately from each other by changing the amount of movement of the discharge unit.

Therefore, the so-called flat-bed type recording apparatus 31 of this embodiment, which includes, as the movement portion, the main body portion 32 provided as the discharge unit, is configured to be able to restrain over-edge of a first image I1 or a second image I2 in the case where the second image I2 is formed on the first image I1.

Figure 8:
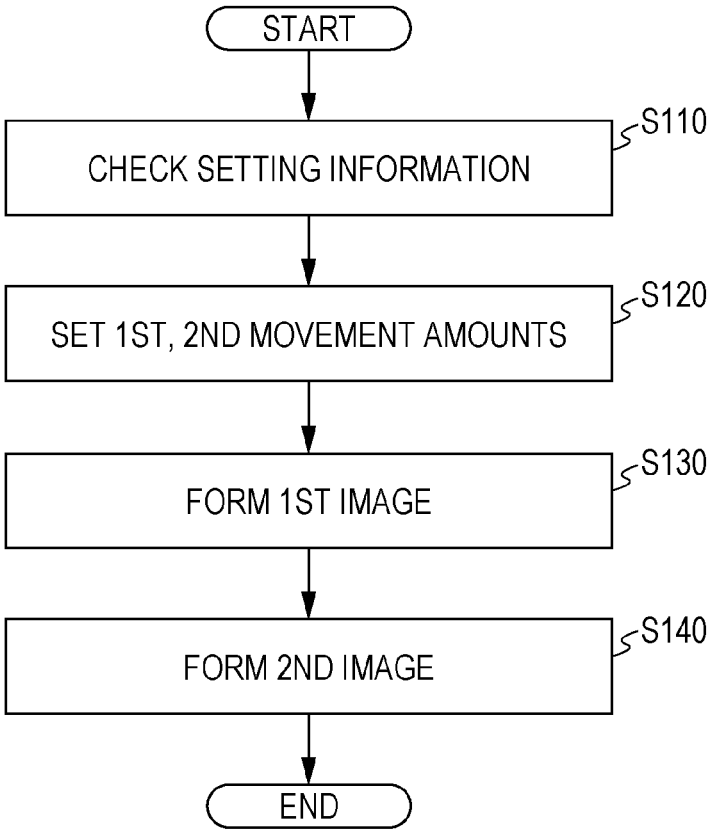
FIG. 8 is a flowchart presenting an image forming method according to an embodiment of the invention.

Embodiment of an Image Forming Method (FIG. 8)

Next, an image forming method according to an embodiment of the invention will be described, using FIG. 8.

Incidentally, the image forming method of this embodiment is an embodiment of the image forming method that is carried out using the recording apparatus 1 of Embodiment 1. However, use of the recording apparatus 21 of Embodiment 2 or the recording apparatus 31 of Embodiment 3 also allows image forming methods similar to the image forming method of this embodiment to be executed if the method for moving the medium P and the discharge portion relatively to each other is appropriately changed.

As presented in FIG. 8, when the image forming method of this embodiment is started after the medium P on the tray 4 is set and recording data is input to the recording apparatus 1 from the PC 17, the control portion 8 first checks the setting information in step S110. Note that the setting information, as mentioned above, is information regarding, for example, the kind of the medium P, the amount of ink deposited onto the medium P, environmental conditions (temperature, humidity, etc.), the kind of ink (liquid), etc., and may be either input by a user via the PC 17 or the touch panel 19 or detected by the recording apparatus 1.

Next, in step S120, the control portion 8 sets the first amount of relative movement between the recording head 7 and the medium P made in the relative movement direction A at the time of the first image forming operation and the second amount of relative movement therebetween made in the relative movement direction A at the time of the second image forming operation, separately from each other. In other words, the control portion 8 sets the first amount of movement in the movement direction A and the second amount of movement in the movement direction A separately from each other in the case where after the first image I1 is formed by the first image forming operation, the second image I2 is formed on the first image I1 by the second image forming operation.

Note that in the case where a medium P that easily swells due to deposit of ink is used, at least one of the first amount of movement and the second amount of movement is changed so that the first amount of movement is smaller than the second amount of movement. In the case where a medium P that easily shrinks due to deposit of ink is used, at least one of the first amount of movement and the second amount of movement is changed so that the first amount of movement is larger than the second amount of movement. Incidentally, although in the image forming method of this embodiment, the second amount of movement is kept at an initial value, it is also permissible to keep the first amount of movement at an initial value and change the second amount of movement.

Next, in step S130, the control portion 8 forms a first image I1 that is a base layer made of a white ink while moving the recording head 7 and the medium P relatively to each other based on the first amount of movement set in step S120.

Incidentally, the formation of the first image I1 is executed by performing recording while moving the tray 4, by the medium transport portion 3, from the recording start position at the back side (right upward direction) in FIG. 1 toward a position that corresponds to the front side in FIG. 1 (in the left downward direction) after the medium P is set on the tray 4 at the position corresponding to the front side in FIG. 1 by a user and the tray 4 on which the medium P has been set is moved to the recording start position using the medium transport portion 3.

Next, in step S140, the control portion 8 forms a second image I2 by color inks on the first image I1 while moving the recording head 7 and the medium P relatively to each other based on the second amount of movement set in step S120.

Note that the formation of the second image I2 is also executed by performing recording while moving the tray 4, by the medium transport portion 3, from the recording start position at the back side in FIG. 1 (in the right upward direction) toward the position corresponding to the front side in FIG. 1 (in the left downward direction) after moving the tray 4 on which the medium P has been set from the position corresponding to the front side in FIG. 1 to the recording start position.

Then, as the formation of the second image I2 in step S140 ends, the image forming method of this embodiment ends.

According to the image forming method of this embodiment, in the case where after the first image I1 is formed the second image I2 is formed on the first image I1, the first amount of movement to be made in the movement direction A during the first image forming operation and the second amount of movement to be made in the movement direction A during the second image forming operation are set separately from each other. In other words, the image forming method of this embodiment is an image forming method used by a liquid discharge apparatus that includes a discharge portion capable of discharging a liquid and a movement portion capable of moving a medium P and the discharge portion relatively to each other and that is capable of executing an image forming operation of forming an image on the medium P by a discharge operation of causing the discharge portion to discharge the liquid and a movement operation of causing the movement portion to move the medium P and the discharge portion in a movement direction A relatively to each other, the method including setting a first amount of movement that is an amount of movement to be made by the movement operation to form a first image I1 and a second amount of movement that is an amount of movement to be made by the movement operation to form a second image I2 separately from each other in the case where after the first image I1 is formed, the second image is formed on the first image I1. Therefore, in the relative movement direction of the recording head 7 and the medium P, over-edge of the first image I1 or the second image I2 formed on the first image I1 can be restrained.

Note that the invention is not limited to the foregoing embodiments but that various modifications or changes can be made within the scope of the invention described in the appended claims and such modifications or the like are encompassed within the scope of the invention.

Concrete embodiments of the invention have been described in detail above. The invention will be recapitulated below.

A liquid discharge apparatus 1 (21 and 31) according to a first mode of the invention includes a discharge portion (7, 27 and 37) capable of discharging a liquid, a movement portion (2, 23 and 32) capable of moving a medium P and the discharge portion (7, 27 and 37) relatively to each other, and a control portion 8 capable of controlling the discharge portion (27 and 37) and the movement portion (2, 23 and 32) and executing an image forming operation on the medium P by a discharge operation performed by the discharge portion (27 and 37) and a movement operation of causing the movement portion (2, 23 and 32) to move the medium P and the discharge portion (27 and 37) relatively to each other. The control portion 8 is capable of changing a first amount of movement to be made in a relative movement direction A by a first image forming operation and a second amount of movement made in the relative movement direction A by a second image forming operation separately from each other in the case where after the first image I1 is formed by the first image forming operation, the second image I2 is formed on the first image I1 by the second image forming operation.

According to this mode, in the case where after the first image I1 is formed the second image I2 is formed on the first image I1, the first amount of movement made in the relative movement direction A in the first image forming operation and the second amount of movement made in the relative movement direction A in the second image forming operation can be changed separately from each other.

Therefore, in the relative movement direction A, over-edge of the first image I1 or the second image I2 formed on the first image I1 can be restrained.

In the liquid discharge apparatus 1 according to a second mode of the invention based on the foregoing first mode, the movement portion is the medium support unit 2 that moves in the relative movement direction A while supporting the medium P, and the control portion 8 is capable of changing the first amount of movement and the second amount of movement separately from each other by changing the amount of movement of the medium support unit 2 in the relative movement direction.

According to this mode, the movement portion is the medium support unit 2 that moves in the relative movement direction A while supporting the medium P. Therefore, in the liquid discharge apparatus 1 that includes the medium support unit 2 as a movement portion, over-edge of the first image I1 or the second image I2 formed on the first image I1 can be restrained.

In the liquid discharge apparatus 21 according to a third mode of the invention based on the foregoing first mode, the movement portion is the transport roller 23 that has its rotation axis in the intersecting direction B that intersects the relative movement direction A, and the control portion 8 is capable of changing the first amount of movement and the second amount of movement separately from each other by changing the amount of rotation of the transport roller 23.

According to this mode, the movement portion is the transport roller 23 that has its rotation axis in the intersecting direction B that intersects the relative movement direction A. Therefore, in the liquid discharge apparatus 21 that includes the transport roller 23 as a movement portion, over-edge of the first image I1 or the second image I2 formed on the first image I1 can be restrained.

In the liquid discharge apparatus 31 according to a fourth mode of the invention based on the foregoing first mode, the movement portion 32 is the discharge unit 32 capable of moving the discharge portion 37 in the relative movement direction A relatively to the support portion 34 on which the medium P is supported, and the control portion 8 is capable of changing the first amount of movement and the second amount of movement separately from each other by changing the amount of movement of the discharge unit 32 in the relative movement direction A.

According to this mode, the movement portion 32 is the discharge unit 32 capable of moving the discharge portion 37 in the relative movement direction A relatively to the support portion 34 on which the medium P is supported. Therefore, in the so-called flat-bed type liquid discharge apparatus 31 that includes the discharge unit 32 as a movement portion 32, over-edge of the first image I1 or the second image I2 formed on the first image I1 can be restrained.

In the liquid discharge apparatus 1 (21 and 31) according to a fifth mode of the invention based on any one of the foregoing first to fourth modes, if the medium P expands due to the first image forming operation, the control portion 8 changes at least one of the first amount of movement and the second amount of movement so that the first amount of movement is smaller than the second amount of movement.

According to this mode, in the case where the medium P expands due to the first image forming operation, at least one of the first amount of movement and the second amount of movement is changed so that the first amount of movement is smaller than the second amount of movement. Therefore, in the case where the medium P that expands when the liquid deposits is used, over-edge of the first image I1 or the second image I2 formed on the first image I1 can be restrained.

In the liquid discharge apparatus 1 (21 and 31) according to a sixth mode of the invention based on any one of the foregoing first to fourth modes, if the medium P shrinks due to the first image forming operation, the control portion 8 changes at least one of the first amount of movement and the second amount of movement so that the first amount of movement is larger than second amount of movement.

According to this mode, in the case where the medium P shrinks due to the first image forming operation, at least one of the first amount of movement and the second amount of movement is changed so that the first amount of movement is smaller than the second amount of movement. Therefore, in the case where the medium P that shrinks when the liquid deposits is used, over-edge of the first image I1 or the second image I2 formed on the first image I1 can be restrained.

In the liquid discharge apparatus 1 (21 and 31) according to a seventh mode of the invention based on any one of the foregoing first to sixth modes, the discharge portion (7, 27 and 37) is capable of moving in the intersecting direction B that intersects the relative movement direction A and discharging the liquid, and the control portion 8 is capable of changing the discharge timing at which the discharge portion (7, 27 and 37) discharges the liquid while moving in the intersecting direction B separately for formation of the first image I1 and for formation of the second image I2.

According to this mode, the discharge portion (7, 27 and 37) is capable of discharging the liquid while moving in the intersecting direction B, and the control portion 8 is capable of changing the discharge timing at which the discharge portion (7, 27 and 37) discharges the liquid while moving in the intersecting direction B separately for formation of the first image I1 and for formation of the second image I2. Therefore, in the liquid discharge apparatus 1 (21 and 31) configured to discharge the liquid from the discharge portion (7, 27 and 37) while moving the discharge portion (7, 27 and 37) in the intersecting directions B, over-edge of the first image I1 or the second image I2 formed on the first image I1 in the intersecting directions B can be restrained.

In the liquid discharge apparatus 1 (21 and 31) according to an eighth mode of the invention based on any one of the foregoing first to seventh modes, the control portion 8 is capable of changing the first amount of movement and the second amount of movement separately from each other based on predetermined setting information.

Note that the "predetermined setting information" is not particularly limited and, for example, may be information regarding the kind of the medium P, the amount of the liquid deposited on the medium P, environmental conditions (temperature, humidity, etc.), the kind of the liquid, etc.

According to this mode, the first amount of movement and the second amount of movement can be changed separately from each other based on predetermined setting information. Therefore, over-edge of the first image I1 of the second image I2 formed on the first image I1 can be restrained with high accuracy according to the kind of the medium P, the amount of the liquid deposited on the medium P, the environmental conditions (temperature, humidity, etc.), the kind of the liquid, etc.

In the liquid discharge apparatus 1 (21 and 31) according to a ninth mode of the invention based on the eighth mode, the medium P is a textile, and the setting information includes information regarding at least one of the material of the medium P, the weaving method of the medium P, and the thickness of yarn that constitutes the medium P.

According to this mode, the medium P is a textile, and the setting information includes information regarding at least one of the material of the medium P, the weaving method of the medium P, and the thickness of yarn that constitutes the medium P. Therefore, in the case where a textile is used as the medium P, over-edge of the first image I1 or the second image I2 formed on the first image I1 can be restrained with high accuracy.

The image forming method according to a further mode of the invention is an image forming method for use by a liquid discharge apparatus that includes a discharge portion (7, 27 and 37) capable of discharging a liquid, a movement portion (2, 23 and 32) capable of moving a medium P and the discharge portion (7, 27 and 37) relatively to each other, and a control portion 8 capable of controlling the discharge portion (7, 27 and 37) and the movement portion (2, 23 and 32) and executing an image forming operation on the medium P by a discharge operation performed by the discharge portion (27 and 37) and a movement operation of causing the movement portion (2, 23 and 32) to move the medium P and the discharge portion (27 and 37) relatively to each other, the method including setting the first amount of movement made in the relative movement direction A in the first image forming operation and the second amount of movement made in the relative movement direction A in the second image forming operation in the case where after the first image I1 is formed by the first image forming operation, the second image I2 is formed on the first image I1 by the second image forming operation.

According to this mode, in the case where after the first image I1 is formed the second image I2 is formed on the first image I1, the first amount of movement made in the relative movement direction A in the first image forming operation and the second amount of movement made in the relative movement direction A in the second image forming operation are set separately from each other. Therefore, in the relative movement direction A, over-edge of the first image I1 or the second image I2 formed on the first image I1 can be restrained.

The entire disclosure of Japanese Patent Application No. 2014-238483, filed Nov. 26, 2014 is expressly incorporated reference herein.

What is claimed is:

1. A liquid discharge apparatus comprising:

a discharge portion capable of discharging a liquid;

a movement portion capable of moving a medium and the discharge portion relatively to each other; and a control portion capable of executing an image forming operation of forming an image on the medium by a discharge operation of causing the discharge portion to discharge the liquid and a movement operation of causing the movement portion to move the medium and the discharge portion relatively to each other in a movement direction, wherein the image includes a first image formed during a first image forming operation and a second image formed over the first image during a second image forming operation, the control portion being capable of changing a first amount of movement that is an amount of movement to be made by the movement operation to form the first image and a second amount of movement that is an amount of movement to be made by the movement operation to form the second image in a case where after the first image is formed, the second image is formed on the first image, and the control portion being capable of executing, at least one of decreasing of the first amount of movement and increasing of the second amount of movement so that if the medium is expected to expand due to formation of the first image, the first amount of movement and the second amount of movement are selected in order to restrain over-edge between the first image and the second image.

2. The liquid discharge apparatus according to claim 1, wherein:

the movement portion is a medium support unit that moves in the movement direction while supporting the medium; and the control portion is capable of changing the first amount of movement and the second amount of movement separately from each other by changing the amount of movement of the medium support unit.

3. The liquid discharge apparatus according to claim 1, wherein:

the movement portion is a transport roller that moves the medium in the movement direction; and the control portion is capable of changing the first amount of movement and the second amount of movement separately from each other by changing an amount of rotation of the transport roller.

4. The liquid discharge apparatus according to claim 1, wherein:

the movement portion is a discharge unit that includes the discharge portion and that moves together with the discharge portion in the movement direction; and the control portion is capable of changing the first amount of movement and the second amount of movement separately from each other by changing the amount of movement of the discharge unit.

5. The liquid discharge apparatus according to claim 1, wherein if the medium shrinks due to formation of the first image, the control portion executes at least one of increase of the first amount of movement and decrease of the second amount of movement.

6. The liquid discharge apparatus according to claim 1, wherein:

the discharge portion is capable of moving in an intersecting direction that intersects the movement direction and discharging the liquid; and the control portion is capable of changing a discharge timing at which the discharge portion discharges the liquid while moving in the intersecting direction separately for formation of the first image and for formation of the second image.

7. The liquid discharge apparatus according to claim 1, wherein the control portion changes at least one of the first amount of movement and the second amount of movement based on setting information.

8. The liquid discharge apparatus according to claim 7, wherein:

the medium is a textile; and the setting information includes information regarding at least one of a material of the medium, a weaving method of the medium, and a thickness of a yarn that constitutes the medium.

9. An image forming method for use by a liquid discharge apparatus that includes a discharge portion capable of discharging a liquid and a movement portion capable of moving a medium and the discharge portion relatively to each other and that is capable of executing an image forming operation of forming an image on the medium by a discharge operation of causing the discharge portion to discharge the liquid and a movement operation of causing the movement portion to move the medium and the discharge portion relatively to each other in a movement direction, wherein the image includes a first image formed during a first image forming operation and a second image formed during a second image forming operation, the method including:

setting a first amount of movement that is an amount of movement to be made by the movement operation to form the first image and a second amount of movement that is an amount of movement to be made by the movement operation to form the second image in a case where after the first image is formed, the second image is formed on the first image, and executing at least one of decreasing of the first amount of movement and increasing of the second amount of movement so that if the medium expands due to formation of the first image, the first amount of movement and the second amount of movement are set in order to restrain over-edge between the first image and the second image.

* * * * *